United States Patent [19]

Nelson et al.

[11] 4,338,615

[45] Jul. 6, 1982

[54] ELECTROSTATIC PRINTER HAVING LED ARRAY WRITE HEAD

[75] Inventors: William E. Nelson; Gene D. Lee, both of Dallas, Tex.

[73] Assignee: Texas Instruments Incorporated, Dallas, Tex.

[21] Appl. No.: 155,875

[22] Filed: Jun. 2, 1980

[51] Int. Cl.[3] ..... G03G 13/22

[52] U.S. Cl. ..... 346/160; 346/153.1

[58] Field of Search ..... 346/74.2, 153.1, 155, 346/159, 160, 139 C; 430/31, 39, 102, 126; 355/16; 101/DIG. 3, DIG. 13

[56] References Cited

U.S. PATENT DOCUMENTS

| | | | |
|---|---|---|---|
| 3,761,173 | 9/1973 | Fotland et al. | 355/16 X |
| 3,787,876 | 1/1974 | Pressman et al. | 355/16 X |
| 3,797,926 | 3/1974 | Fotland et al. | 355/16 X |
| 4,087,826 | 5/1978 | Haeberle | 346/155 |
| 4,122,459 | 10/1978 | Schloemann et al. | 346/74.2 X |
| 4,138,685 | 2/1979 | Kellerman | 346/74.2 |
| 4,155,093 | 5/1979 | Fotland et al. | 346/159 |

OTHER PUBLICATIONS

Harris, Optical Printer, IBM Technical Disclosure Bulletin, vol. 13, No. 12, 5/71, pp. 3757–3758.

*Primary Examiner*—Stuart N. Hecker

*Attorney, Agent, or Firm*—Melvin Sharp; Richard L. Donaldson; Gary C. Honeycutt

[57] ABSTRACT

An apparatus and method for printing on plain paper, utilizing a solid-state write head to electrostatically release a pattern of dry toner particles from an informationless toner carrier. The pattern of released toner particles is accelerated across an air gap by an electrical field to impact on the paper.

10 Claims, 4 Drawing Figures

ELECTROSTATIC PRINTER HAVING LED ARRAY WRITE HEAD

BACKGROUND OF THE INVENTION

This invention relates to printer/copier systems and more specifically to systems employing an electrostatic printing process.

Electrostatic printer technology has previously involved the delivery of information to a photo conductive surface to form a latent electrostatic image which is then toned, physically moved, and electrostatically transferred to a contacting paper substrate. Such electrostatic printer technology has been embodied in several ways. Laser address printers utilize a laser to raster across a rotating photo-conductive drum to create a latent electrostatic image as the laser is modulated on and off, similar to a TV scan. The image is then toned and transferred as previously described. The major advantage of the laser system is speed, which can go up to several thousand lines per minute. However, it has several major disadvantages. The mechanical-optical interface is very complex, as is the latent image process, the physical size is quite large, and the cost is high.

The Dennison process of electrostatic printer technology utilizes an array of electrodes to write a latent image on a dielectric surface. In effect, the laser is replaced with an electrode system and the photoconductive surface replaced with ordinary dielectric. Most of the disadvantages are still present as the latent image process is retained, and in addition, the electrodes require high voltage to write on the dielectric. Since this method is not adaptable to integrated solid state technology for addressing the hundreds of electrodes, matrix addressing is required.

The Versatec printing method uses an electrode array to write a latent image on a dielectric layer, which is on the surface of a special paper. The latent image transfer process is done away with, but at the expense of requiring special paper. In a related application, Nelson teaches in U.S. Pat. No. 4,146,898 a magnetic tape on which information is recorded, the tape passed through a toner application where toner is attracted to the tape at the areas where magnetic information is recorded (latent magnetic image). The tape then moves to a transfer area where it passes between plain paper and two electrodes. A high potential is pulsed between the two electrodes to transfer the toner from the tape to the paper across an air gap.

Kilby, in U.S. Pat. No. 3,979,758, shows an electrostatic process where the addressable printhead creates a charge on small plates on the head. Toner is brushed across the head, and toner particles attracted by the charged plates form an image. The head is then moved and the toner transferred by contact to plain paper.

The toner required for each application described is, in most cases, specially made for that application. Generally, particles of the selected pigmented are subjected to a process which coats the particles of pigment with resin. The resin coating allows the particles to be electrically charged, and to be transferred from surface to surface until fixed on the desired surface by heat or other means presently used.

SUMMARY OF THE INVENTION

The present invention provides an electrostatic printing apparatus and method that utilizes a solid state write head to release sharply defined patterns of toner particles from an informationless toner carrier. The patterns are accelerated across an air gap by an electrical field, and deposited on plain paper or any other suitable surface.

In one embodiment of the present invention, there is provided an addressable solid state write head comprising a linear array of electrodes with 200 or more of them per inch across the width of the printing area. The circuitry for addressing of the electrodes is either integrated in the write head or peripheral to it. Each electrode, when addressed, creates an electrostatic field. A thin, flexible belt or other substrate is subjected to a corona charging process which generates an electrical charge on the belt. The electrical charge on the moving belt attracts oppositely charged toner particles as it passes the toner supply and carries them past the write head as a uniform film where the electrostatic fields from the write array repel selected areas of toner particles away from the toner carrier belt. Once particles are released from the attraction of the toner carrier belt, they are attracted across a small gap toward the paper by an electrical field created by an electrode (or corona) located behind the paper, and held there by the mechanical force of impact (or residual corona charge) until the paper is moved to a point where a standard copier method fixes the toner.

In the preferred embodiment of the invention, a thin, flexible belt incorporating a layer of photoconductive material is used as a toner carrier. An example of such a belt would be a layer of photoconductive cadmium sulfide particles embedded in a transparent plastic binder that is laminated to a transparent conductive supporting substrate. An LED array of a material exhibiting the optimum photoemissive characteristic for use with the proposed toner carrier photoreceptor is used as the means for release of toner particles from the carrier. For example, GaAs (gallium arsenide) is a suitable material. The array of LED's selectively discharge sites on the photoconductive material of the belt. Toner is not repelled from the belt, but the charge on the photoconductor material at sites where light is focused is so reduced that the attractive force of the electrical field generated by the electrode or corona behind the paper pulls the toner particles away from the belt and across a small air gap. For example, 0.010–0.020 inches to the paper. The transfer electrode is of the corona type, and biased to operate with a field strength just sufficient to attract particles across the air gap from discharged areas, but not from unilluminated areas.

A key feature of the preferred embodiment of the present invention is the transfer of toner directly to plain paper. This is in contrast to the usual practice, where latent electrostatic images are formed on an intermediate surface, then coated with toner, and plain paper pressed against the intermediate surface while an electrical charge causes the toner to be transferred to the paper.

In accordance with the present invention, toner never touches the write head, nor does paper contact anything except toner particles coming across the air gap. In addition, toner has no information associated with it until actually released from toner carrier by the write head. The write head, by selecting the places where toner particles will be released, imparts information to the toner particles.

The present invention contemplates the use of existing methods for fixing toner on paper, after deposition.

Methods of paper transport and synchronization are well known to those skilled in the art, and will not be discussed here.

DESCRIPTION OF THE PREFERRED EMBODIMENT

Figure 1:
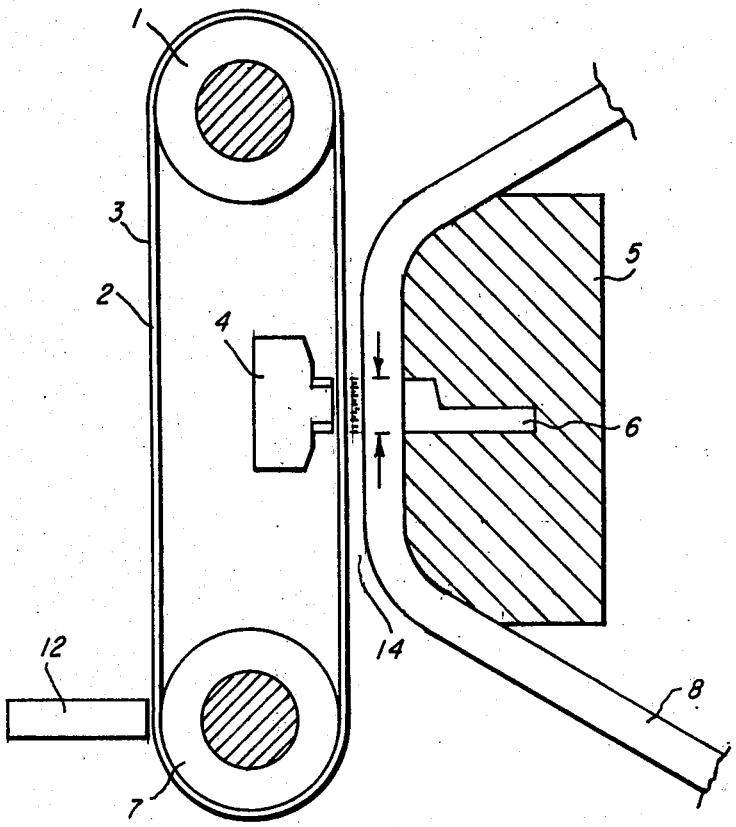
FIG. 1 is a side view of one embodiment of the present invention.
Figure 2:
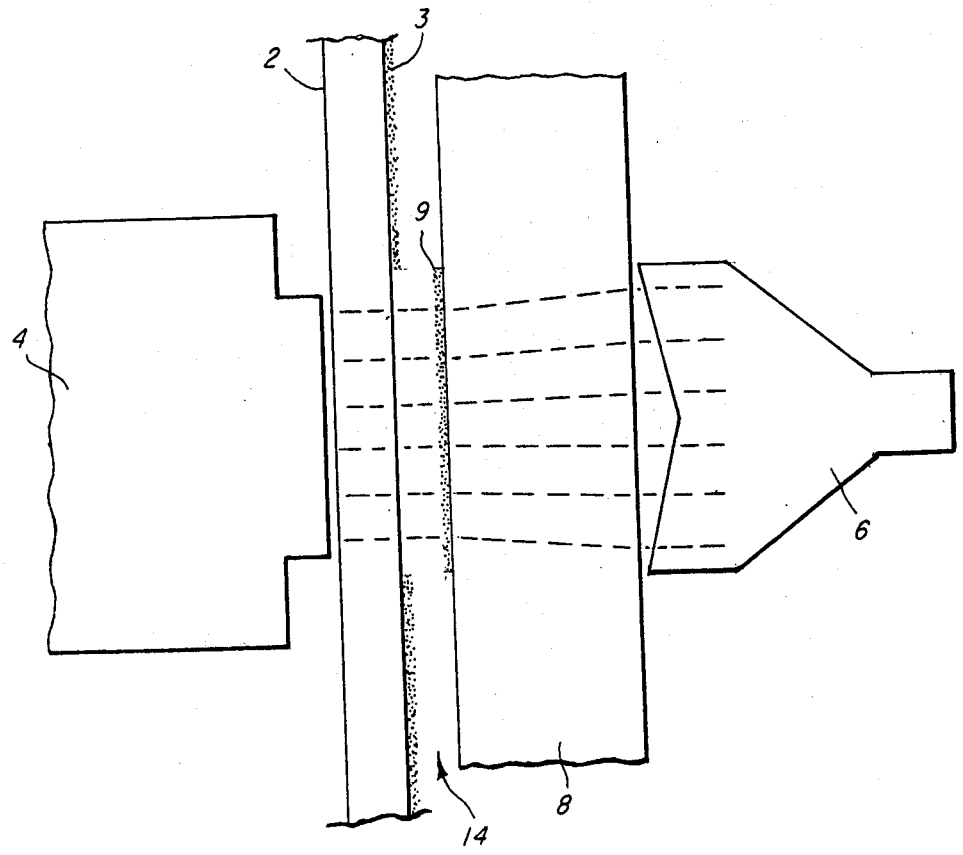
FIG. 2 is a detailed side view showing the direct toner transfer across an air gap.

FIGS. 1 and 2 illustrate a printing method based on the electrostatic toner transfer process, but that is greatly reduced in complexity and physical size as it does away with the creation and transfer of a latent image, instead, depositing toner directly on plain paper. In one embodiment, a thin, belt-type substrate 2 is driven by a drive roller 1 around a static roller 7. As the corona charged belt moves past toner applicator 12, a triboelectric process creates a charge on the particles of resin coated toner which are attracted to and uniformly coat the carrier belt. As the informationless toned surface 3 moves past the solid-state addressable write head 4, the information to be printed is decoded and the appropriate electrodes in the write head are energized. The electrical field created by energizing of write head electrodes repels a pattern of toner particles from the toner carrier corresponding to the electrodes energized to the write head. These toner particles 3, once free from the toner carrier 2, are attracted across air gap 14 to the paper 8 by the electrical field created by electrode 6. The toner particles on the paper 9 create the printed information.

Figure 3:
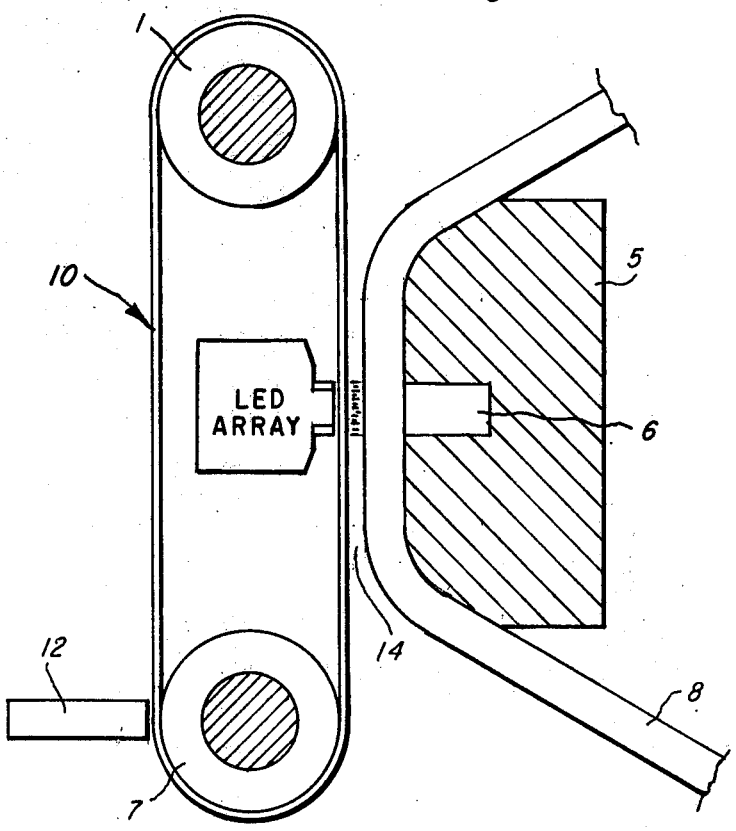
FIG. 3 is a side view of a second embodiment of the present invention.
Figure 4:
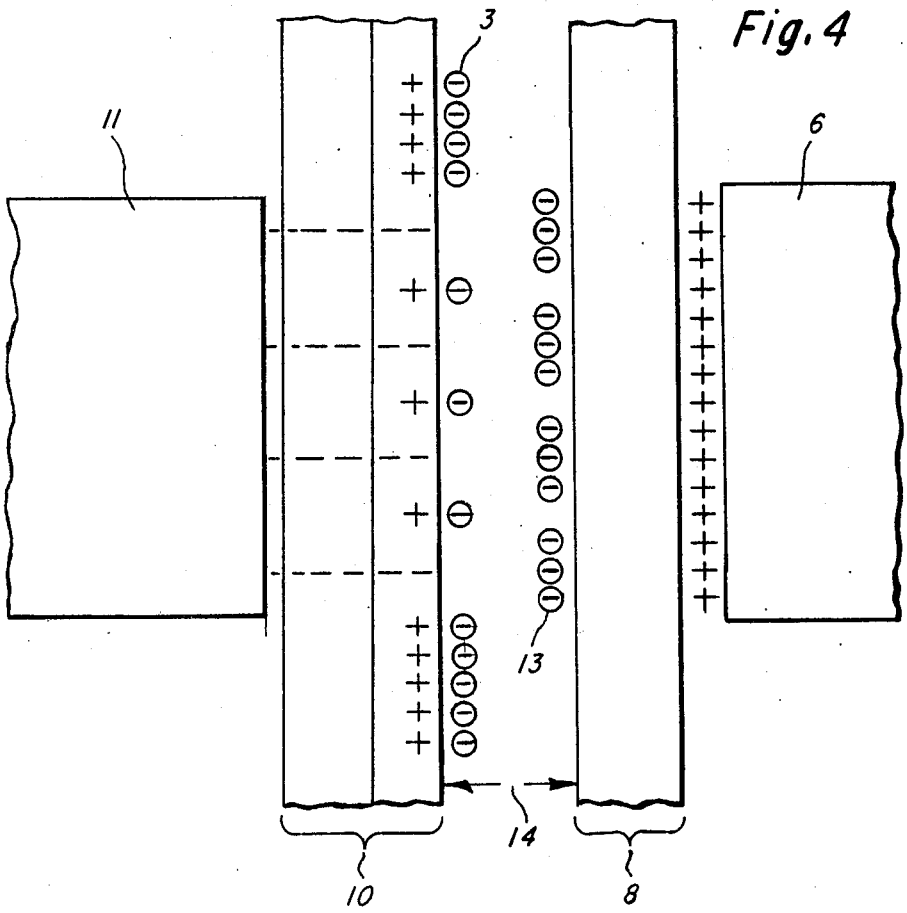
FIG. 4 shows the details of the direct toner transfer across the air gap for the second embodiment.

FIGS. 3 and 4 show the preferred embodiment, wherein the toner carrying substrate 10 is a transparent film belt 15 with a layer of transparent ohmic layer and a photoconductive material 16 in or on the free side of the belt. The write head of this embodiment is an LED array 11. As the toner carrier moves past the LED array, information to be printed is decoded and appropriate LED's are activated. The light penetrating the transparent film belt discharges the photoconductive layer 16 at certain sites, removing the charge that causes an attraction of the toner particles 3 to the photoconductive layer 16. The electrical field generated by the electrode 6 then pulls the toner particles 13 across the air gap 14 to the paper 8.

What is claimed is:

1. An apparatus for generation of a permanent visible image from a set of electrical signals, comprising:

means including an electrically charged photoconductive layer for providing a continuous unpatterned supply of a particulate medium for development of said image;

means for selecting and releasing a particular pattern of particles of said medium from said supply of medium; and means for transferring said pattern of particles across an air gap to a substrate.

2. The apparatus of claim 1, wherein said means for providing a continuous unpatterned supply of medium comprises a thin, flexible, belt-type sheet, and unpatterned medium comprises toner.

3. The apparatus of claim 1, wherein said means for selecting and releasing a pattern of particles comprises a solid-state LED array write head having discretely addressable segments.

4. The apparatus of claim 1, wherein said means for transfer of pattern of particles across an air gap comprises an electrode located behind said substrate.

5. The apparatus of claim 1, wherein said means for providing a continuous unpatterned supply of medium comprises a transparent substrate material, having said layer of photoconductive substance between layers of or on one side of said material, formed as a continuous belt.

6. The apparatus of claim 5, wherein said means for selection and release of a pattern of particles comprises a LED array for discharge of sites on said photoconductive substrate to release said pattern of particles.

7. A method for printing on plain paper, comprising the following steps;

(a) delivering a constant supply of unpatterned particulate medium on an electrically charged substrate incorporating a photoconductive substance;

(b) selecting and releasing a pattern of particles of said medium from said supply;

(c) transferring said released pattern of particles across an air gap to a substrate.

8. A method for selecting and releasing of said pattern of particles provided in accordance with claim 7, including the step of generating sharply defined electrical fields capable of repelling said pattern of particles from said continuous supply.

9. A method for providing a continuous supply of unpatterned particulate medium, comprising subjecting a moving substrate to an electrostatic charging process, thereby causing said substrate to become electrically charged; applying said particulate medium to said charged substrate which attracts and carries said particulate medium due to said electrical charge; and selecting and releasing a pattern of particles from the substrate, including the step of modulating an LED array to discharge selected sites on said substrate, thereby releasing said pattern of particles.

10. A method as in claim 9, further including the step of attracting said released patterns of particles across an air gap to a substrate, by placing an electrode opposite said continuous supply of medium and behind said substrate, thereby released pattern of particles are attracted across air gap to the substrate.

* * * * *